US007631634B2

(12) United States Patent
Ramamurthy et al.

(10) Patent No.: US 7,631,634 B2
(45) Date of Patent: Dec. 15, 2009

(54) FUEL DELIVERY MODULE FOR HIGH FUEL PRESSURE FOR ENGINES

(75) Inventors: Dhyana Ramamurthy, Novi, MI (US); Kingo Okada, W. Bloomfield, MI (US)

(73) Assignee: DENSO International America, Inc., Southfield, MI (US)

( * ) Notice: Subject to any disclaimer, the term of this patent is extended or adjusted under 35 U.S.C. 154(b) by 83 days.

(21) Appl. No.: 11/983,364

(22) Filed: Nov. 8, 2007

(65) Prior Publication Data

US 2009/0120413 A1 May 14, 2009

(51) Int. Cl.
*F02M 37/08* (2006.01)
*F02M 37/00* (2006.01)

(52) U.S. Cl. ..... 123/511; 123/459

(58) Field of Classification Search ..... 123/509, 123/511, 512, 514, 510, 457, 459
See application file for complete search history.

(56) References Cited

U.S. PATENT DOCUMENTS 5,477,829 A 12/1995 Hassinger et al.
5,769,061 A * 6/1998 Nagata et al. ..... 123/509
6,412,475 B1 * 7/2002 Joos et al. ..... 123/510
6,532,941 B2 3/2003 Begley et al.
6,622,702 B2 9/2003 Yomogida et al.
6,622,707 B2 9/2003 Begley et al.
7,353,807 B2 * 4/2008 Paluszewski ..... 123/509
7,469,683 B2 * 12/2008 Mason et al. ..... 123/509
2004/0173188 A1 * 9/2004 Braun ..... 123/509
2005/0133430 A1 * 6/2005 de Savasse et al. ..... 210/234
2006/0231079 A1 * 10/2006 Paluszewski ..... 123/514

* cited by examiner

*Primary Examiner*—Mahmoud Gimie
(74) *Attorney, Agent, or Firm*—Harness, Dickey & Pierce, PLC

(57) ABSTRACT

A fuel pump module comprising a fuel pump, a pressure regulator, a supply line check valve, a relief valve, and a flange adapted to engage a fuel supply line that fluidly links the fuel pump module with an injector rail. The pressure regulator is adapted to maintain a predetermined fuel pressure between the fuel pump and the supply line check valve. The supply line check valve is adapted to facilitate a minimum fuel pressure in the fuel supply line. The relief valve is adapted to limit the maximum fuel pressure in the fuel supply line. The supply line check valve, the relief valve, and the flange are integrated to form a single fluidly interconnected structure disposed within a fluid path between the pressure regulator and the fuel supply line. An integrated casing may house the fuel pump and the pressure regulator.

22 Claims, 7 Drawing Sheets

FUEL DELIVERY MODULE FOR HIGH FUEL PRESSURE FOR ENGINES

FIELD

The present disclosure relates to valve arrangement in a fuel pump module that provides high pressure in a fuel line thereby ensuring optimal fuel pressure during engine starting.

BACKGROUND

The statements in this section merely provide background information related to the present disclosure and may not constitute prior art. Conventional vehicular fuel systems, such as those installed in automobiles, may employ a "return fuel system," whereby a fuel supply tube or line is utilized to supply fuel from a fuel tank to an engine and a fuel return tube or line is utilized to return unused fuel from the engine to the fuel tank.

Typically, more modern vehicles employ a "returnless fuel system" that may be either mechanically or electrically controlled. In many returnless fuel systems, such as a mechanical returnless fuel system ("MRFS") a fuel pump continuously pumps a constant flow of fuel from a fuel tank to the engine. In another type of returnless fuel system, such as an electronic returnless fuel system ("ERFS"), the voltage across the fuel pump is controlled to vary the fuel pumped to the engine. A pressure regulator controls the pressure of fuel directed to the engine, and discharges excess fuel back into the fuel tank. This eliminates the need for a return line, hence the term "returnless fuel system."

When the engine is operating, fuel is delivered to the engine at a relatively low pressure, for example, at 400-450 kilopascals (kPa). The engine may then be turned off, and for a time period after the engine is turned off but still radiating heat, the fuel remaining in the fuel injector rail and the fuel line may be heated by the engine, other hot components of the vehicle, and/or high ambient air temperatures. Under these conditions, low pressure fuel in the fuel rail or any fuel lines may vaporize. As such, fuel vapor in the injector rail or fuel lines can cause vapor lock, which in turn, may hinder or prevent ignition or combustion during an attempted engine restart.

Prior known fuel systems lack a satisfactory means for managing fuel pressure and flow within the fuel system, both during and after an engine's operation, in an efficient, space-conscious manner.

SUMMARY

A fuel pump module may employ a fuel pump, a pressure regulator, a fuel supply line check valve, a fuel line pressure relief valve, and a fuel pump module flange, which may be adapted to engage a fuel supply line that fluidly links the fuel pump module with a fuel injector rail. The pressure regulator may be adapted to maintain a predetermined fuel pressure between the fuel pump and the fuel supply line check valve. The fuel supply line check valve may be configured to facilitate a minimum fuel pressure in the fuel supply line while the relief valve may be configured to limit the maximum fuel pressure in the fuel supply line. The fuel supply line check valve, the relief valve, and the flange may be integrated to form a single, fluidly interconnected structure disposed within a fluid path between the pressure regulator and the fuel supply line. A single case or multiple cases molded together to form an integrated casing may house the fuel pump and the pressure regulator. The single, fluidly interconnected structure and the integrated casing may be fixedly engaged with each other to form a modular unit.

The supply line check valve and the pressure relief valve may be vertically arranged and fluidly parallel to each other. Alternatively, a single housing structure may house a vertically oriented supply line check valve and a horizontally oriented pressure relief valve, or a horizontally oriented supply line check valve and a vertically oriented pressure relief valve in the single housing structure. Furthermore, in yet another arrangement, the single housing structure may be welded to the flange to become integral and permanently fastened to the flange. The flange and the single housing structure may form a fluid passage that fluidly links the pressure relief valve and the supply line check valve. The supply line check valve and the pressure relief valve may be fluidly linked in a hoseless fashion to increase durability and reduce parts.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
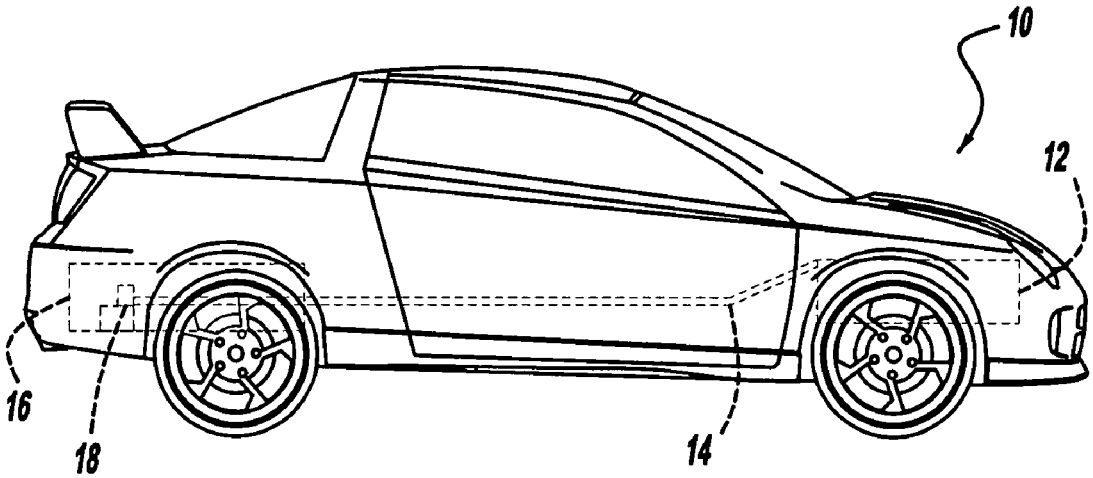
FIG. 1 is a side view of a vehicle depicting a fuel system in phantom.

The following description is merely exemplary in nature and is not intended to limit the present disclosure, application, or uses. It should be understood that throughout the drawings, corresponding reference numerals indicate like or corresponding parts and features. With reference to FIGS. 1-14, a fuel pump module adaptable to an electronic returnless fuel system ("ERFS") or a mechanical returnless fuel system ("MRFS") will be described.

FIG. 1 depicts a vehicle 10, such as an automobile, having an engine 12, a fuel supply line 14, a fuel tank 16, and a fuel pump module 18. The fuel pump module 18 mounts within the fuel tank 16 with a flange and is normally submerged in or surrounded by varying amounts of liquid fuel within the fuel tank 16 when the fuel tank 16 possesses liquid fuel. A fuel pump within the fuel pump module 18 pumps fuel to the engine 12 through a fuel supply line 14.

Figure 2:
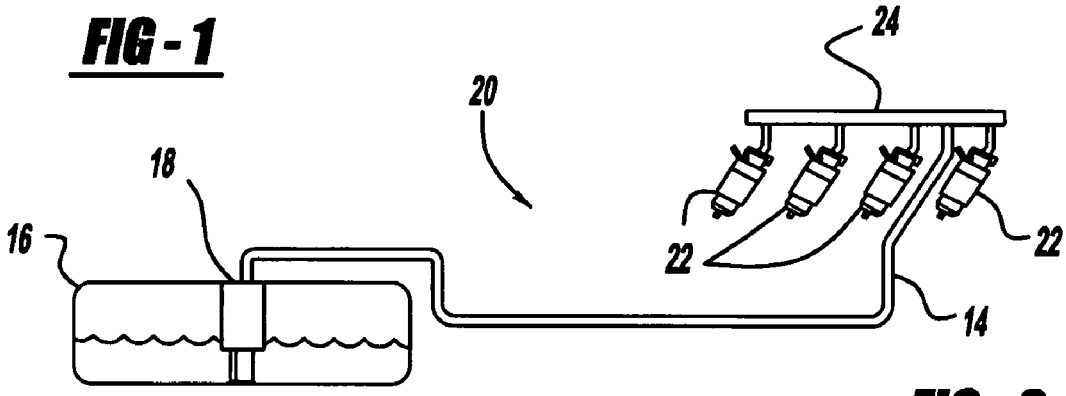
FIG. 2 is a side view of a vehicle fuel supply system depicting fuel injectors.

FIG. 2 is a perspective view of a fuel supply system 20 depicting fuel injectors 22. In a returnless fuel system, only a fuel supply line 14 carries fuel between the fuel pump module 18 and a common fuel injector rail 24. Once the fuel reaches the injector rail 24, also called a "common rail," as depicted in FIG. 2, the fuel passes into individual fuel injectors 22 before being sprayed or injected into individual combustion chambers of the internal combustion engine 12. The fuel supply system 20 has no fuel return line from the injector rail 24 to the fuel tank 16.

Figure 3:
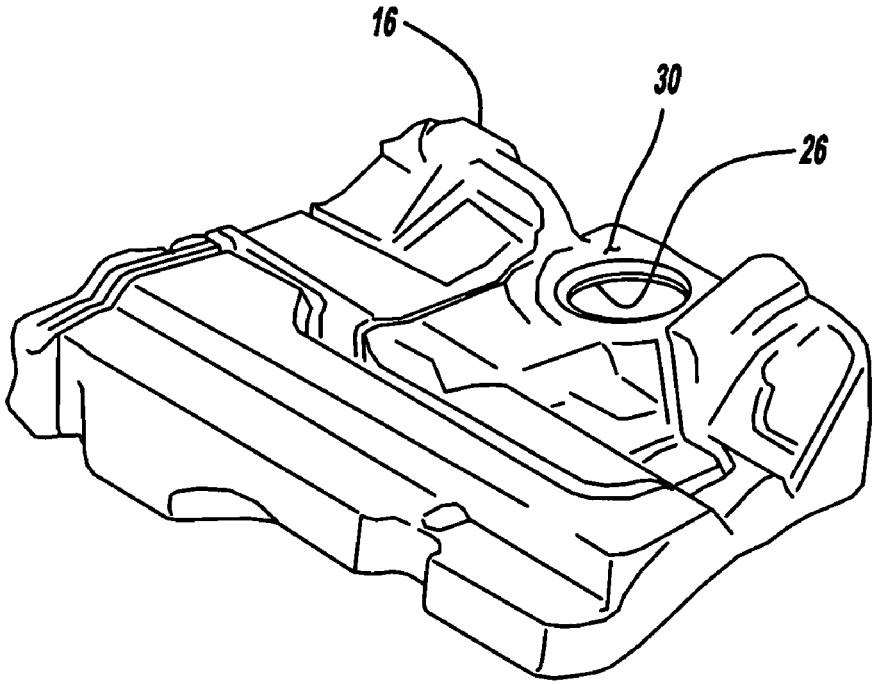
FIG. 3 is a perspective view of a vehicle fuel tank depicting the location of a fuel pump module.
Figure 4:
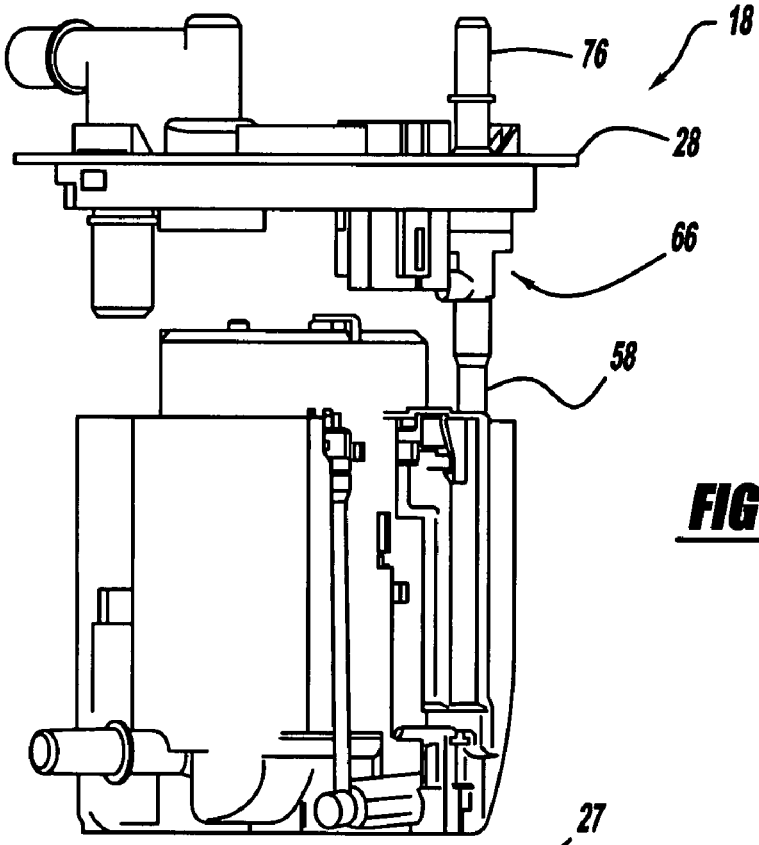
FIG. 4 is a side view of an example of a fuel pump module in accordance with teachings of the invention.

FIG. 3 is a perspective view of a vehicle fuel tank 16 depicting a mounting location 26, a hole, about which is a mounting surface 30 for a fuel pump module 18. FIG. 4 depicts one embodiment of a fuel pump module 18 that may be lowered through the hole 26 of the fuel tank 16 when installed. More specifically, a flange 28 rests on the mounting surface 30 on the top of the fuel tank 16 when the fuel pump module 18 is in its installed position. Additionally, the fuel pump module 18 of FIG. 4 depicts a generally vertical cylindrical reservoir 36. Alternatively, the reservoir may be oriented generally horizontally (not shown). An advantage of a horizontal reservoir is that less fuel tank depth is necessary to accommodate such. Alternatively, an advantage of a vertically oriented fuel pump module reservoir is that less horizontal space is necessary for its installation. That is, generally a vertical reservoir has a smaller overall diameter than a horizontal reservoir for the same vehicle application.

Figure 5:
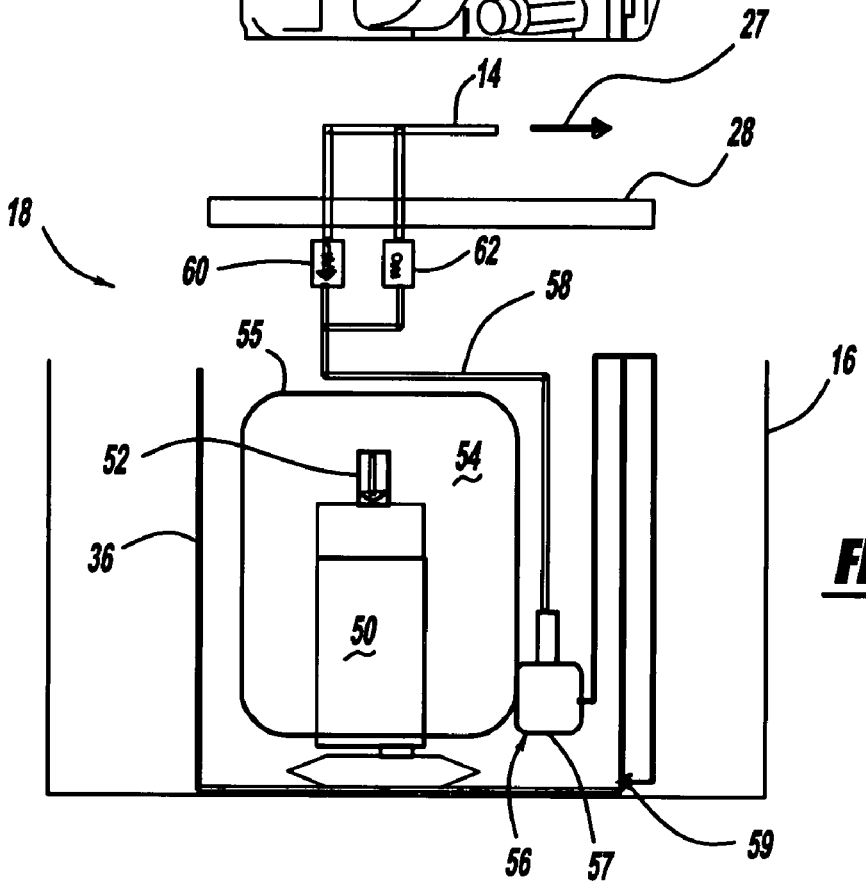
FIG. 5 is a side view of a fuel pump module depicting valve arrangement in accordance with teachings of the invention.

With reference mainly to FIG. 5, the fuel pump module 18 includes a fuel pump 50 which draws fuel from the reservoir 36 and pumps the fuel through a fuel pump check valve 52 disposed at or near the top of the fuel pump 50. The fuel pump check valve 52 opens in response to positive pressure from within the fuel pump 50 to permit fuel to flow from the top and out of the fuel pump and into the filter 54 surrounding the fuel pump 50. In this manner, the fuel pump check valve 52 permits fuel to be pumped from the fuel pump 50 while preventing fuel from flowing in the opposite direction, that is, into the fuel pump 50. Fuel pressure is maintained within and through the filter 54 disposed around the fuel pump 50, but within a fuel filter case 55.

Continuing with FIG. 5, fuel is pumped into the filter 54 and forced through the filter 54 toward the bottom of the reservoir 36 where the fuel passes through a hole and into a pressure regulator 56. The pressure regulator 56 may be disposed within a pressure regulator case 57. The pressure regulator case 57 may be attached to the fuel filter case 55, or integrally formed with the fuel filter case 55. The pressure regulator 56 is in fluid communication with the fuel supply line 14 via a feed line 58. As is known, the pressure regulator 56 regulates fuel pressure in the feed line 14. Fuel that passes from the pressure regulator 56 flows into and through the feed line 58 toward the flange 28. The pressure regulator 56 may be either mechanically controlled with a spring, for example, or electrically controlled. The fuel pressure in the feed line 58, downstream of the pressure regulator 56, is hereinafter referred to as the reference pressure. Fuel flow 27 is the fuel flow that is pumped from the pump 50, through the check valve 60 and to the engine 12.

Figure 7:
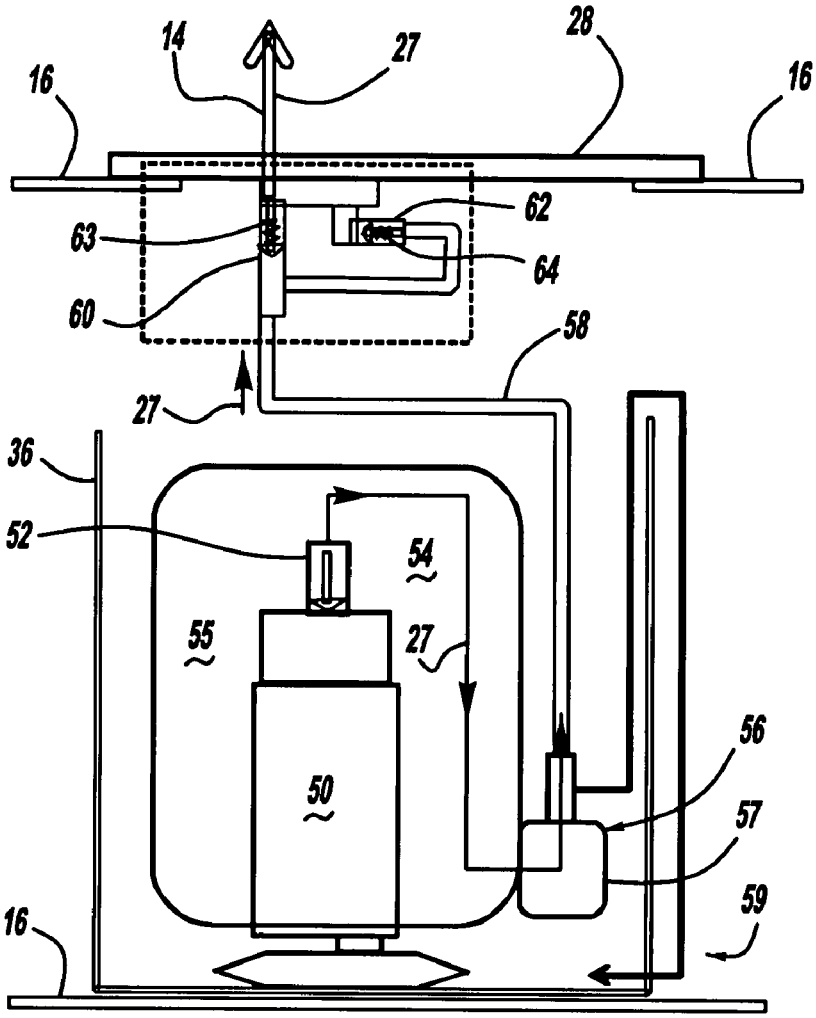
FIG. 7 is a side view of a fuel pump module depicting valve arrangement in accordance with teachings of the invention.

The pressure regulator 56, in addition to passing fuel into the feed line 58 at the desired pressure in accordance with the reference setting pressure of the pressure regulator, re-circulates excess fuel, beyond that which is needed to maintain the reference pressure, back into the reservoir 36 so that it again may be drawn into the fuel pump 50. Relatively low pressure fuel, or rather that pressure to which the regulator is manufactured, is also routed from the pressure regulator 56 to a jet pump 59 disposed near or at the bottom of the fuel tank 16, as depicted in FIGS. 5 and 7. A Venturi effect is created by the flow of fuel through the jet pump 59 thereby drawing fuel from the fuel tank 16, or more specifically from the bottom of the fuel tank 16, and into the reservoir 36. Depending upon the design of the reservoir 36, the reservoir 36 may or may not actually contact the interior bottom of the fuel tank 16, which may or may not then permit fuel to enter the reservoir through the bottom of the reservoir.

Figure 6:
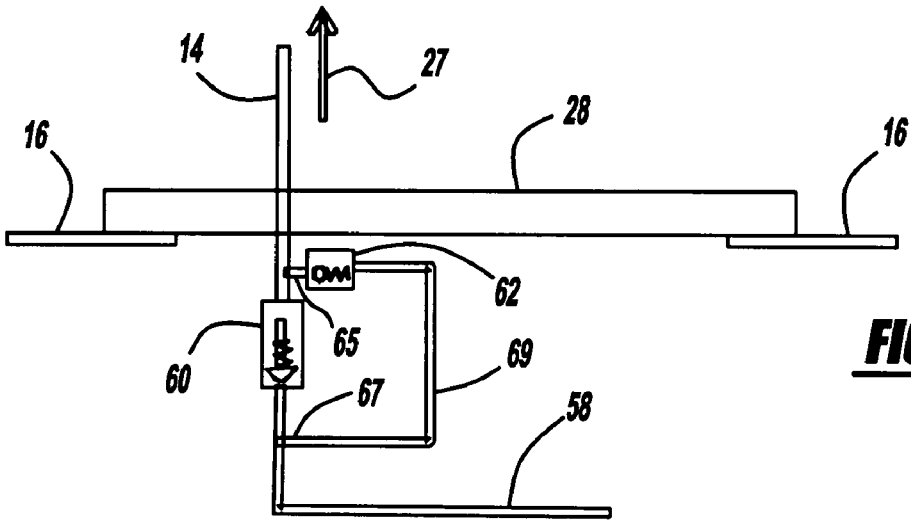
FIG. 6 is a side view of a fuel pump module depicting valve arrangement in accordance with teachings of the invention.

The pressure regulator 56 is fluidly linked to a supply line check valve 60 and a relief valve 62 via the feed line 58. The supply line check valve 60 is arranged fluidly parallel to the relief valve 62 (FIGS. 5-7). The supply line check valve 60 is adapted to open in response to fuel pressure in the feed line 58 when the fuel pressure in the feed line 58 is at or above the reference pressure to allow fuel to flow from the pressure regulator 56, through the feed line 58, and into the fuel supply line 14. The pressure required to open the check valve 62 is approximately 15-20 kPa, which is much lower than a typical pressure regulator set point of 400-450 kPa. A relief valve spring 64 and the residual pressure regulator pressure, or pressure measurable at the pressure regulator, biases the relief valve 62 closed. In this manner, the supply line check valve 60 maintains a minimum pressure (equal to the reference pressure) in the fuel supply line 14.

When the engine is not running, such as immediately after turning off the ignition, heat from the engine 12 may heat the fuel in the fuel supply line 14, thereby increasing the pressure in the fuel supply line 14 above the reference pressure. The fuel in the fuel supply line 14 may also be heated by the ambient air, as opposed to or in addition to heat from the engine 12, such as on a very hot summer day such that the ambient air is hot enough to raise the temperature and thus the pressure of the fuel in the fuel supply line 14 above the reference pressure. Still yet, heat may emanate from black pavement or asphalt which has been heated by sunlight. In one example, if a car is driven so as to bring the engine temperature up to a steady operating temperature, and then the car is parked on asphalt that has been subjected to direct sunlight at least 2 hours, as an example, and then the vehicle ignition is turned off, the fuel temperature may rise. Additionally, the fuel pressure in the fuel line 14 may rise above the combined pressure of the spring 64 and the pressure regulator pressure (pressure in line 58). If the fuel pressure in the fuel supply line 14 rises above a maximum allowable pressure or maximum predetermined pressure, the biasing force of the relief valve spring 64 is overcome or countered with force such that the relief valve 62 opens, thereby allowing fuel of a pressure higher than the set pressure of the relief valve 62 to flow out of the fuel supply line 14. As a result, the pressure in the fuel supply line 14 decreases below the maximum allowable pressure. From the relief valve 62, fuel pressure may be vented back into the feed line 58. If the pressure in the feed line 58 is above the reference pressure, the pressure regulator 56 discharges fuel back into the reservoir 36 to maintain the reference pressure in the feed line 58. The reservoir 36 is open to the fuel tank 16, which may be vented to a charcoal canister.

The supply line check valve 60 and the relief valve 62 may be arranged vertically and physically parallel to each other, as shown in FIG. 5. Such an arrangement will utilize vertical space, as opposed to horizontal space, and as such, packaging within the fuel tank 16 may be made possible. In another embodiment or arrangement depicted in FIG. 6, the relief valve 62 may be located anywhere along a relief valve tube 69, which has ends 65, 67 that fluidly communicate on either side of the supply line check valve 60. In another alternative embodiment depicted in FIG. 8, the relief valve 62 may be arranged horizontally and perpendicular to the vertically arranged supply line check valve 60.

In another embodiment, FIGS. 8-13 will be referenced. The supply line check valve 60 and the relief valve 62 may integrally form a structure that is a single housing 66. The single housing 66 includes a feed line port 70 that engages with the feed line 58. The feed line 58 is retained or secured on the feed line port 70 by a push-on friction fitting between the feed line 58 and successive protrusions or barbs 74 that are disposed on the feed line port 70. The protrusions 74 readily accept the feed line 58 when installed in a press-on direction toward the flange 28, but resist disconnection in the opposite or removal direction away from the flange 28. The supply line check valve 60 is in fluid communication with a supply line stem 76 disposed on the flange 28, and may be slidably received therein. The supply line stem 76 fluidly links the supply line check valve 60 and the fuel supply line 14. The supply line stem 76 may be integrally formed or molded with the flange 28, and is adapted to engage the fuel supply line 14 in a fixed and secure fashion.

The supply line check valve 60 and the relief valve 62 may be disposed below the flange 28, as shown in FIGS. 4-9 and 14. A surface 77 (FIG. 8) of the single housing 66 that houses the supply line check valve 60 and the relief valve 62 meets a mounting surface 78 (FIG. 10) disposed on the underside of the flange 28 when assembly of the flange is complete. Mounting surfaces 77, 78 may be joined together using hot plate welding such that the single housing 66 becomes integral to the flange 28. In this manner, the single housing 66 and the flange 28 may cooperate to fluidly link the supply line check valve 60 and the relief valve 62. In an alternative embodiment, the single housing 66 may be fastened to the flange 28 via an interference or snap fit, bolts, or other suitable joining methods known in the art. However, an advantage of the hot plate welding joining technique is that a permanent joint, which is leak-proof, is created. Furthermore, additional, separate fasteners are not required. Finally, because the flange 28 and single housing 66 may be handled as a single, joined piece, installation onto and into the fuel tank 16 is simple and quick.

Figure 8:
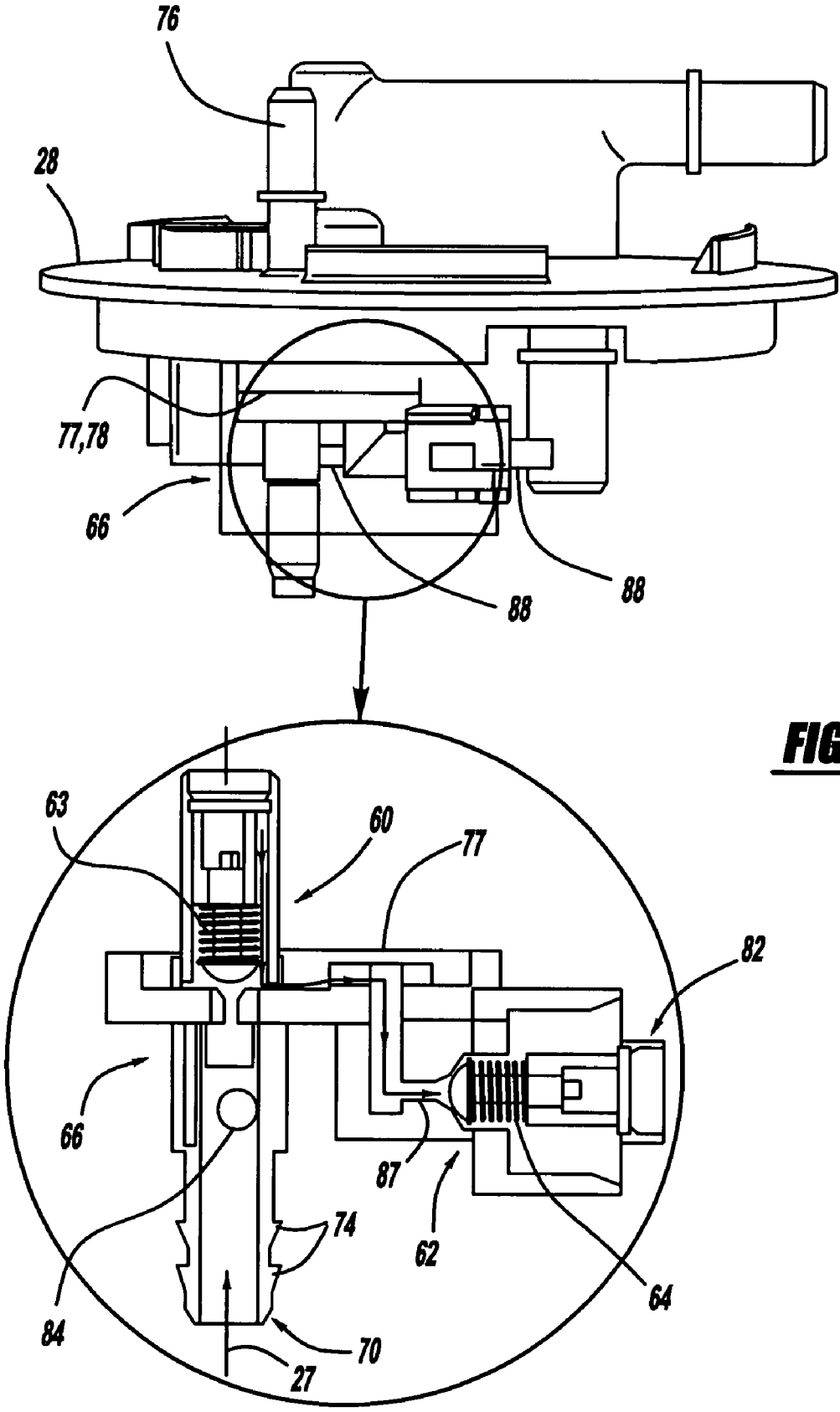
FIG. 8 is a side view of a fuel pump module depicting valve arrangement in accordance with teachings of the invention.
Figure 9:
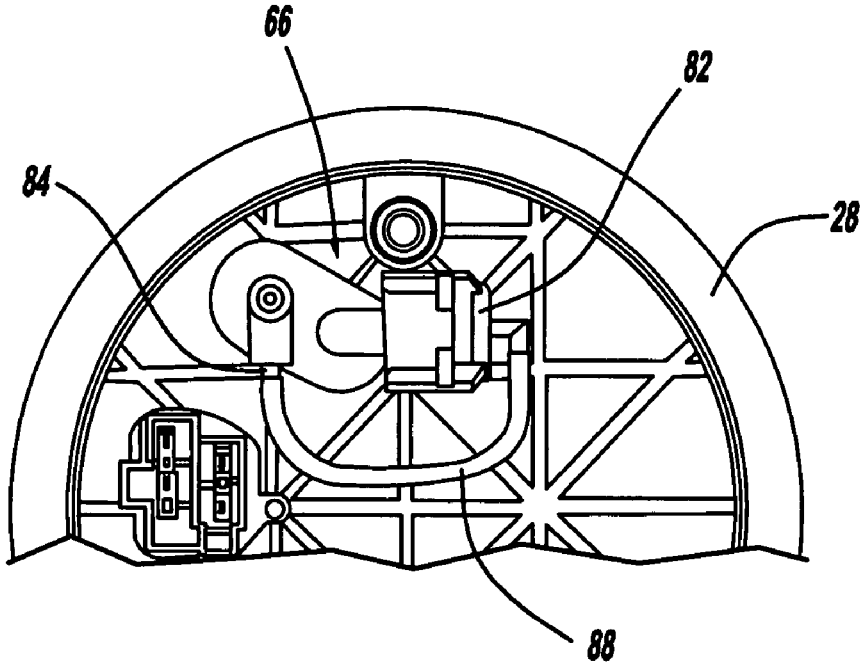
FIG. 9 is a bottom view of a fuel pump module flange and valve locations in accordance with teachings of the invention.
Figure 10:
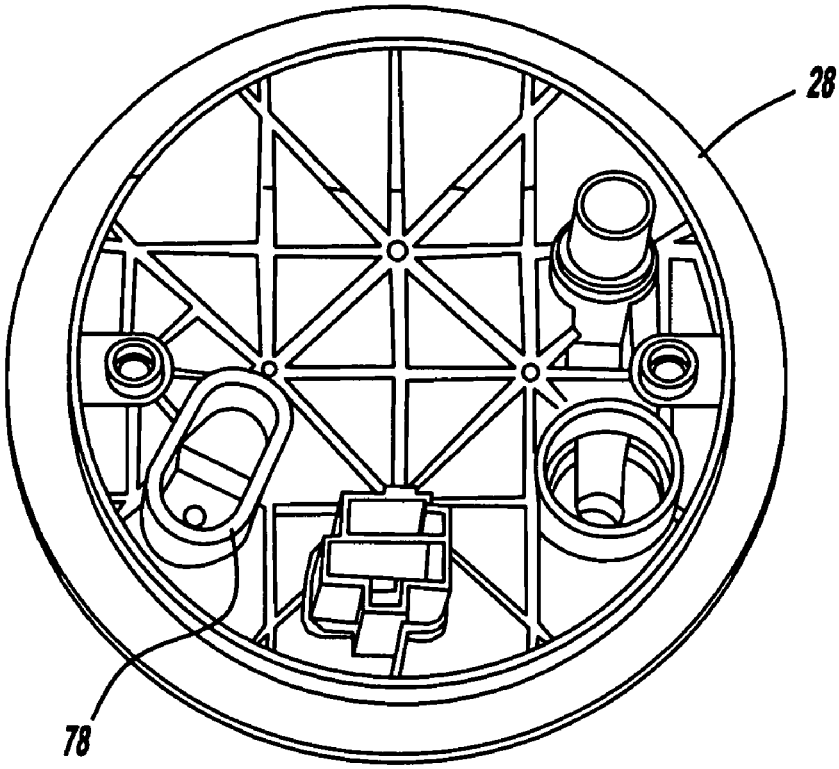
FIG. 10 is a bottom perspective view of an attachment location of fuel pump module valves in accordance with teachings of the invention.
Figure 11:
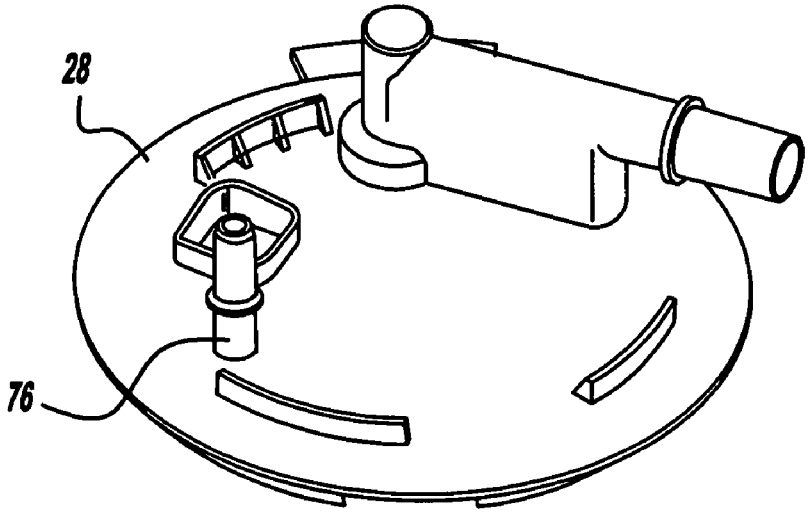
FIG. 11 is a top perspective view of a fuel pump module flange in accordance with teachings of the invention.
Figure 12:
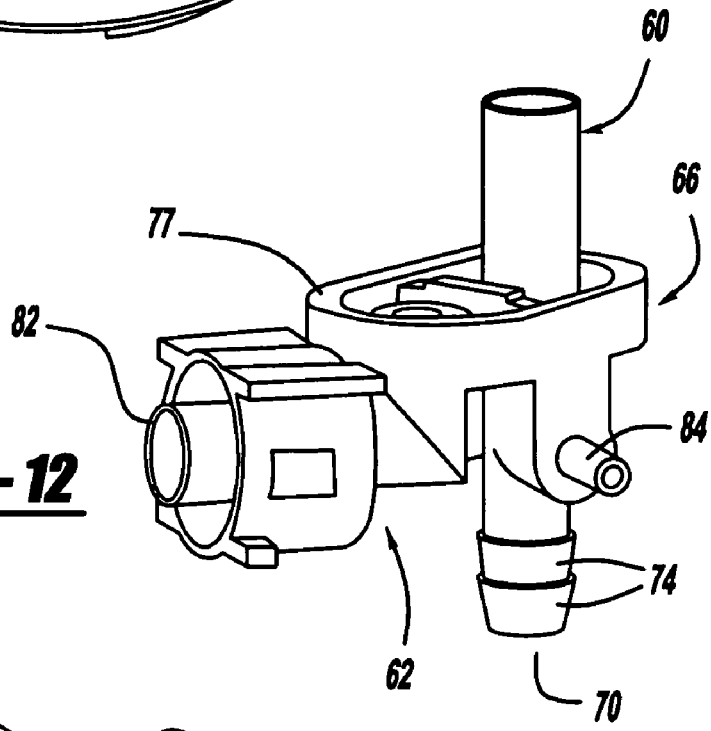
FIG. 12 is a perspective view of a valve assembly in accordance with teachings of the invention.
Figure 13:
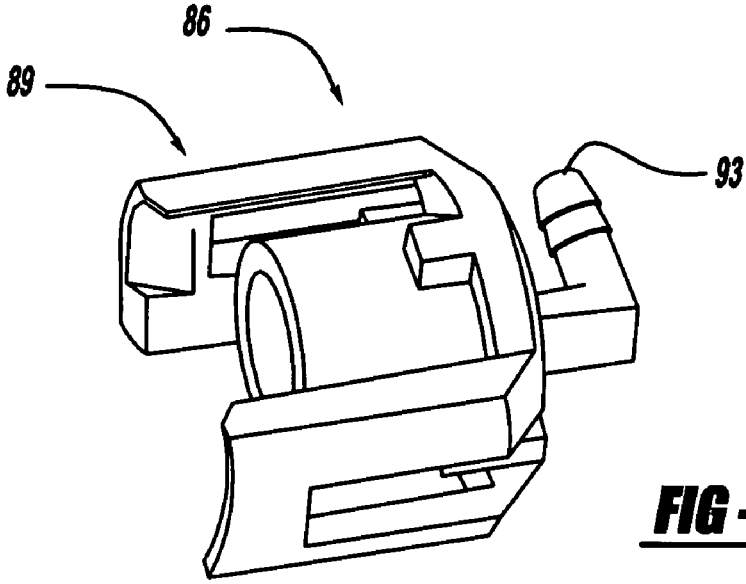
FIG. 13 is a perspective view of a connector in accordance with teachings of the invention.

Continuing with reference to FIGS. 8-13, the single housing structure 66 includes a relief outlet port 82 adapted for fluid communication with a port 84 (FIG. 9). The relief outlet port 82 may be fluidly connected with the port 84 via a connector 86, and a connecting hose 88. The connector 86 may include a clip portion 89 that connects with the housing 66 or the relief outlet port 82. The connector 86 may also include a port 93 that connects with the connecting hose 88. The connecting hose 88 connects with the port 84, thus fluidly linking hose 58 with the reference side of the relief valve 62 at port 82. This results in the set point (pressure set point) of the pressure regulator 56 augmenting the set point (pressure set point) of the relief valve 62 itself, thereby resulting in an increased relief set point (pressure set point). Alternatively, the hose 88 may be a rigid structure such as a hard plastic and be integrally formed to the port 82 and port 84. Such a structure would reduce part counts, eliminate connection joints, and reduce manufacturing and assembly time.

In this configuration, upon actuation of the relief valve 62 to relieve pressure in the fuel supply line 14, fuel travels through the relief outlet port 82, through the connector 86 and the connecting hose 88, into the feed line port 70 via the port 84, and into, that is down through, the feed line 58, into the pressure regulator 56, and back into the reservoir 36 (only if the feed line pressure exceeds the pressure regulator set point), which is ultimately vented to the tank at approximately atmospheric pressure, as previously described. Again, an advantage of the embodiment depicted in FIGS. 7-13 is that a single housing 66 may be welded to the flange 28 to create one piece for assembly to and into the fuel tank 16.

Figure 14:
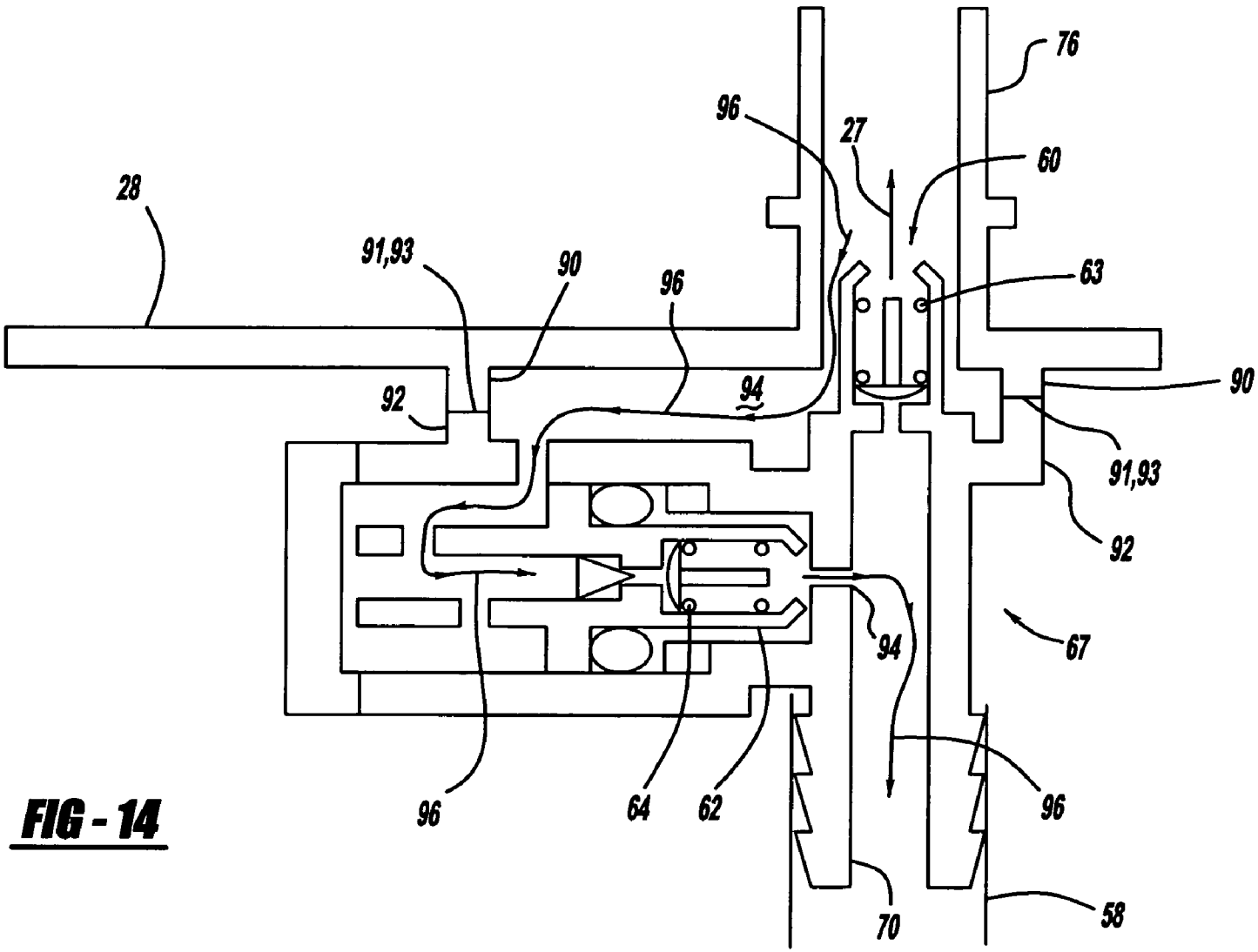
FIG. 14 is a side view of a hoseless valve arrangement and mounting in accordance with teachings of the invention.

In yet another embodiment depicted in FIG. 14, the relief valve 62 and the supply line check valve 60 are configured within a single housing structure 67. A direct fluid link to the feed line port 70 via an aperture 94 from the supply line stem 76 and thus the supply line 14 is established, without using hoses to establish such a link.

With continued reference to FIG. 14, during normal supply of fuel to the engine 12 while the engine is operation, fuel passes through the check valve 60 by biasing the spring 63, which is set to open at a certain reference pressure, as described above. When the engine 12 is not operating, pressure in the supply line 14 forces the check valve 60 closed so that no fuel flows through the check valve 60. However, upon the pressure in the fuel supply line 14 increasing above a predetermined pressure in the fuel line 14, as governed by the spring 64 of the pressure relief valve 62 and the pressure in the line 58, the pressure relief valve 62 will open and thus permit pressure to be relieved into the feed line 58 from the fuel line 14.

To create a fuel flow path from the interior of supply line stem 76 to the feed line port 70, the flange 28 has a rim 90 or legs protruding from it on an underside of the flange 28. Additionally, the single housing 67 has a rim 92 or legs 92 protruding upward from it such that the rim 90 and rim 92 meet to form a joint. Such a joint at interface surfaces 91, 93 of the rims 90, 92 may be created using hot plate welding and be leak-proof and permanent. Interface surface 91 being on rim 90 while interface surface 93 is on rim 92. Because the rims 90, 92 are protrusions, a cavity 94 is formed by their joining such that fuel is permitted to flow in accordance with flow arrow 96 from the fuel supply line 14 to the feed line 58. An advantage of the embodiment depicted in FIG. 14 is that no hoses are used to connect the feed line 58, and thus its pressure, to the reference of the relief valve 62. Thus, fewer separate parts are necessary during assembly and additionally, hose joints or couplings do not exist, which may become uncoupled during fluid flow through valves that utilize hoses.

There are multiple advantages to the teachings of the present disclosure. First, the fuel pump module 18 is capable of delivering fuel at a relatively low reference pressure to the engine 12 during operation, while maintaining high fuel pressure in the fuel supply line 14 when the engine 12 is off. Such is possible because the spring 63 in the check valve 60, which permits fuel to flow to the engine via the fuel supply line 14, is set to open at a pressure lower than the spring 64 in the relief valve 62, which permits fuel to flow from the engine, or rather from the fuel supply line 14.

The diameter of orifice 87 of FIG. 8 may be varied, such as made relatively small or large, such that as the diameter of the orifice 87 is made smaller, the force at orifice 87 acting upon the spring 64 of relief valve 62, assuming constant pressure in line 14, may be lowered. Thus, a single valve 62 may be used in multiple fuel pump modules in multiple vehicle applications, but by varying the diameter of orifice 87, a higher or lower force acting on the spring 64 of the relief valve 62 may be experienced. In other words, by varying the diameter of the orifice 87, the force due to line pressure necessary to counter or open the relief valve 62, may be varied. This aspect permits a single valve 62 to be used in multiple modules but with a varied orifice 87 diameter. Still yet, the diameter of orifice 87 may be varied along with the spring constant or spring stiffness of spring 64 to attain or meet the required relief pressure in line 14. Of course the pressure regulator set point (a pressure and thus a force in line 58) and the spring stiffness (force) counter the pressure and force in line 14 that act upon the valve 62, which may be preceded by an orifice. Thus, to attain a high pressure in the line 14, or attain the desired relief pressure, at least three items may be adjusted: a reduced diameter of the orifice 87, an increased spring constant or stiffness of spring 64, and an increased set point of the pressure regulator 56.

The advantage of maintaining high pressure in the fuel supply line 14 and the injector rail 24 is that high pressure, that is, pressure high enough to prevent fuel vaporization, prevents vaporization of the fuel and thus, vapor lock, thus increasing the reliability of starting of the engine 12, especially during hot days or when the fuel supply line 14 and injector rail 24 are susceptible to fuel vapor lock. Further, high fuel pressure in the fuel supply line 14 and the injector rail 24 at start-up facilitates more efficient and complete combustion, thus reducing fuel consumption, due to longer starting times, and prolonged noxious exhaust emissions during engine starting. Fuel consumption may be reduced because the engine 12, as equipped with the teachings above, will start more quickly when the pressure in the fuel supply line 14 is maintained at a higher pressure even when the engine 12 is not operating. That is, no time is spent creating pressure in the fuel supply line 14 in the few seconds or even a portion of a second prior to actual sustained combustion of the engine 12. The higher pressure is maintained as a result of the spring stiffness of the relief valve.

There are multiple advantages to the integral construction of the fuel pump module 18 according to the present disclosure. Integrally forming the single housing structure 66 to the flange 28 mitigates a potential leak source by joining the two components as one. Joins and couplings are reduced. A single modular unit also saves space within the fuel tank 16 since hoses typically need nipples or leads for connection. Such leads utilize precious space within the module and fuel tank. Further, integral construction facilitates easy installation of the fuel pump module 18 into the fuel tank 16. The integral construction also provides convenient access for servicing components of the fuel pump module 18, as disengaging the flange 28 from the fuel tank 16 enables easy access to the entire fuel pump module 18, which may easily be lifted from the tank without components, such as valves, etc. dangling from connection hoses. The single housing structure 67 saves space in the fuel pump module 18 and the fuel tank 16 by locating the valves 60, 62 as close as possible to the flange 28, with no hoses, or just a single hose. Additionally, selectively placing the valves 60, 62 in specific horizontal or vertical arrangements also efficiently utilizes space within the module 18 and fuel tank 16. Finally, with integral construction, parts will not become detached thus compromising functionality of the module during operation.

The description of the present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A fuel pump module for delivering fuel from a fuel tank to an engine, the fuel pump module comprising:

a flange;

a fuel pump and a fuel filter, the fuel filter surrounding the fuel pump to receive fuel;

a fuel supply line check valve located downstream of the fuel filter, the fuel supply line check valve for releasing fuel to the engine;

a pressure relief valve located downstream of the fuel filter and mounted physically parallel with the fuel supply line check valve, the fuel supply line check valve and the pressure relief valve both located under the flange and permitting fluid flow in opposite directions;

a pressure regulator that governs a reference pressure of the pressure relief valve, the pressure regulator located within a fluid path between the fuel pump and the fuel supply line check valve; and a fuel pump check valve connected to a top of the fuel pump, the fuel pump check valve for retaining pressure in the fluid path between the fuel pump and the fuel supply line check valve located under the flange.

2. The fuel pump module of claim 1, wherein the fuel supply line check valve and the pressure relief valve are vertically arranged.

3. The fuel pump module of claim 1, wherein the fuel supply line check valve and the pressure relief valve are integral with the flange.

4. The fuel pump module of claim 1, wherein a fluid link between the pressure relief valve and the fuel supply line check valve is made with a hose.

5. The fuel pump module of claim 1, wherein a fluid link between the pressure relief valve and the fuel supply line check valve is hoseless.

6. The fuel pump module of claim 1, further comprising:

a single housing structure within which the supply line check valve and the pressure relief valve reside.

7. The fuel pump module of claim 6, wherein the single housing structure is welded to the flange.

8. The fuel pump module of claim 7, wherein the single housing structure is hot plate welded to the flange to become integral to the flange.

9. The fuel pump module of claim 8, wherein the pressure relief valve is arranged horizontally and the supply line check valve is arranged vertically to utilize space under the flange.

10. The fuel pump module of claim 9, wherein the pressure relief valve and the supply line check valve are fluidly linked in a hoseless fashion.

11. The fuel pump module of claim 9, wherein the flange and the single housing structure together form a fluid passage that fluidly links the pressure relief valve and the supply line check valve.

12. The fuel pump module of claim 1, wherein the pressure relief valve further comprises an inlet orifice with a diameter smaller than an exit diameter.

13. A fuel pump module within a fuel tank, the fuel pump module comprising:

a fuel pump surrounded by a fuel filter, the fuel pump and fuel filter disposed within a single fuel filter case;

a pressure regulator case housing a pressure regulator, the pressure regulator case fixed adjacent-to the fuel filter case;

a check valve, for releasing fuel to the engine, and a pressure relief valve, the check valve and the pressure relief valve mounted within the fuel tank, arranged fluidly in parallel, and located downstream of the fuel filter; and a fuel pump check valve mounted atop the fuel pump, the fuel pump check valve for maintaining pressure in a fuel path between the fuel pump check valve and the pressure regulator.

14. The fuel pump module of claim 13, further comprising:

a single housing structure within which the check valve and the pressure relief valve reside.

15. The fuel pump module of claim 14, wherein the single housing structure is fastened to the flange.

16. The fuel pump module of claim 15, wherein the single housing structure is hot plate welded to the flange to become integral to the flange.

17. The fuel pump module of claim 13, wherein the pressure relief valve and the check valve are fluidly and hoselessly linked.

18. A fuel pump module within a fuel tank, the fuel pump module comprising:

a fuel pump and a fuel filter disposed within a single fuel filter case;

a pressure regulator case housing a pressure regulator, the pressure regulator case fixed adjacent to the fuel filter case;

a flange to which a single housing structure is welded;

a check valve and a pressure relief valve arranged fluidly in parallel as part of a single housing structure, both the check valve and the pressure relief valve located downstream of the fuel filter; and a fuel pump check valve mounted atop the fuel pump, the fuel pump check valve for maintaining pressure in a fuel path between the fuel pump check valve and the pressure regulator when the fuel pump is not operating.

19. The fuel pump module of claim 18, wherein the check valve and the pressure relief valve are fluidly parallel and fluidly linked with a single hose.

20. The fuel pump module of claim 18, wherein the check valve and the pressure relief valve are fluidly parallel and fluidly linked hoselessly.

21. The fuel pump module of claim 18, wherein the flange and the single housing structure together form a fluid path to the pressure relief valve.

22. The fuel pump module of claim 18, the pressure relief valve further comprises an inlet orifice with a diameter smaller than an exit diameter.

* * * * *